US007874372B2

(12) United States Patent
Varkey et al.

(10) Patent No.: US 7,874,372 B2
(45) Date of Patent: Jan. 25, 2011

(54) WELL ACCESS LINE POSITIONING ASSEMBLY

(75) Inventors: Joseph Varkey, Sugar Land, TX (US); Peter Fitzgerald, Paris (FR); Hifzi Ardic, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 230 days.

(21) Appl. No.: 12/170,512

(22) Filed: Jul. 10, 2008

(65) Prior Publication Data

US 2009/0020294 A1 Jan. 22, 2009

Related U.S. Application Data

(60) Provisional application No. 60/950,447, filed on Jul. 18, 2007.

(51) Int. Cl.
*E21B 19/22* (2006.01)

(52) U.S. Cl. ..... 166/384

(58) Field of Classification Search ..... 166/380, 166/384, 77.1, 77.2
See application file for complete search history.

(56) References Cited

U.S. PATENT DOCUMENTS 3,163,222 A 12/1964 Foster et al.
3,332,484 A 7/1967 Watkins
3,378,066 A 4/1968 Kivisild
3,493,043 A 2/1970 Watkins
3,517,738 A 6/1970 Petersen
3,675,713 A 7/1972 Watkins
3,709,291 A 1/1973 Hanes et al.
3,945,213 A 3/1976 Forbes et al.
4,024,718 A 5/1977 Roche et al.
6,151,774 A * 11/2000 Nold, III ..... 29/822

FOREIGN PATENT DOCUMENTS

GB 2345708 A 7/2000

* cited by examiner

*Primary Examiner*—William P Neuder
(74) *Attorney, Agent, or Firm*—Michael L. Flynn; David Hofman; Jody Lynn DeStefanis

(57) ABSTRACT

An assembly for positioning a well access line in a well. The assembly is located between a supply of well access line and a well, with the line running through the assembly and to the well. Multiple pulleys are incorporated into the assembly about which a well access line such as a conventional wireline may be wrapped. The pulleys are biased to one another such that slack in the line may be stored at the assembly and drawn on in the event of line tension spiking up to a predetermined amount. As such, tension in the line may be kept to a minimum so as to avoid damage to the line during a well access operation. Furthermore, should the tension in the line fail to come back down to below the predetermined amount, the well access operation may be halted in an automated manner. Halting may proceed while continuing to allow take-up of the slack in the line until completed halting of the operation is achieved.

27 Claims, 5 Drawing Sheets

WELL ACCESS LINE POSITIONING ASSEMBLY

CROSS REFERENCE TO RELATED APPLICATION(S)

This Patent Document claims priority under 35 U.S.C. §119(e) to U.S. Provisional Application Ser. No. 60/950,447, entitled Mitigation of Shock Wave and High-Tension Spooling Issues in Cables Used for Oil Exploration, filed on Jul. 18, 2007, which is incorporated herein by reference.

FIELD

Embodiments described relate to well access lines for positioning of downhole tools within a well. In particular, embodiments of assemblies and techniques for use in conjunction with such well access lines are detailed. These assemblies and techniques may be employed to help avoid damage to a well access line during the positioning of a downhole tool.

BACKGROUND

Exploring, drilling, completing, and operating hydrocarbon and other wells are generally complicated, time consuming, and ultimately very expensive endeavors. In recognition of these expenses, added emphasis has been placed on well access, monitoring and management throughout its productive life. Ready access to well information and intervention may play critical roles in maximizing the life of the well and total hydrocarbon recovery. As a result, downhole tools are frequently deployed within a given hydrocarbon well throughout its life. These tools may include logging tools to acquire data relative to well conditions as well as intervention tools to address downhole conditions.

The above noted downhole tools are generally delivered to a downhole location by way of a well access line. The line may be delivered by way of a winch at the surface of the oilfield which is directed to deploy the line into the well. The line itself may be a wireline cable or slickline for dropping the tool vertically into the well or a coiled tubing line for driving the tool downhole in a powered manner, such as for a highly deviated well. Regardless, once positioned to a desired downhole location, a well application may be employed by the tool at the end of the line. In conjunction with, or subsequent to, performing the downhole application, the winch may then be employed to withdraw the well access line and tool from the well.

Unfortunately, the well access line is susceptible to sustaining damage as it is positioned. That is, during the described advancing or withdrawing of the well access line, a load may be placed on the line which results in damage to the line. For example, the well access line may be a coiled tubing line as indicated. As such, a significant amount of power may be employed to drive the line through a tortuous or deviated section of the well. Thus, the coiled tubing line may be susceptible to sustaining buckling damage, for example, where it is directed to traverse a bend in the well that results in imparting a significant load on the end of the coiled tubing.

In another scenario, a well access line in the form of a wireline cable may sustain damage or even be broken during an attempt to withdraw from the well. For example, in many cases, the tool at the end of the line may become stuck in place downhole. This may be due to the presence of an unforeseen obstruction, unaccounted for restriction, differential sticking of the tool against the well wall, a malfunctioning tractor, or for a host of other reasons. Indeed, with the presence of increasingly deeper and more deviated wells, the likelihood of a downhole tool becoming stuck merely due to the depth and architecture of the well alone is increased. Regardless, once stuck downhole, an attempt to withdraw the wireline may lead to cold-flow damage and ultimately breaking of the line.

Once a wireline cable is broken as indicated above, potentially several thousand feet of line may be left in the well. To prevent this circumstance, a weakpoint is generally built into the logging head at the tool. Thus, the continued pull on the tool through the line may result in leaving only the downhole tool and part of the logging head behind. Unfortunately, this will generally require a subsequent fishing operation in order retrieve the tool from the well. Such a fishing operation may result in shutting down of hydrocarbon production for anywhere from a few hours to a few weeks. Ultimately, such a shut down may come at a cost of several hundred thousand to perhaps millions of dollars in lost production.

In an attempt to avoid such lost production time, efforts have been made at early detection of loads imparted on the well access line during downhole positioning thereof. So, for example, a detector may be placed at the winch to determine the amount of tension being imparted on the well access line, say a wireline cable, during its withdrawal as described above. Thus, as the wireline cable is withdrawn from the well, the load thereon may be monitored. As such, a signal may be sent to the winch to halt the withdrawal of the cable upon detection of a load approaching a predetermined amount thought to be damaging to the cable.

Unfortunately, early detection of load increase is generally insufficient to prevent damage to the line. For example, in the above scenario of withdrawing a wireline cable, withdrawal will generally take place at a very high speed, say between about 25,000 and 50,000 feet per hour. As a result, the natural delay between a detected spike in tension and the actual shutting down of the winch is such that damage to, or breaking of, the cable will generally result in spite of the early detection. Even though the natural delay between detection and effective shutting down of the winch may only be a few milliseconds, the spike in tension resulting in cable damage may be even shorter. Given the particular scenario of an obstructed tool or cable that is being withdrawn at high speed, the time between encountering a load due to an obstruction and damage to the line may be less than a millisecond. Furthermore, altering withdrawal to a low speed procedure in order to allow adequate time between load detection and shutting down of the winch would be substantially cost prohibitive.

SUMMARY

A well access line positioning assembly is provided. The assembly includes first and second pulleys about which a well access line may be wrapped. The pulleys may be biased relative to one another by the well access line thereabout. In this manner, an adjustable distance may be provided between the pulleys which is based on the amount of tension in the well access line.

DETAILED DESCRIPTION

Embodiments are described with reference to certain well access operations. For example, wireline retrieval of a logging tool during a logging operation is described. However, alternate well access operations, tools, and techniques may take advantage of well access line positioning assemblies as detailed herein. Such well access operations may include other types of wireline operations as well as coiled tubing operations. Regardless, embodiments detailed herein include an assembly for positioning between a supply of well access line and a well. The assembly is configured to provide slack in the line that may be taken up in the event of a sudden spike in tension on the line, thereby avoiding significant damage to the line during well access operations.

Figure 1:
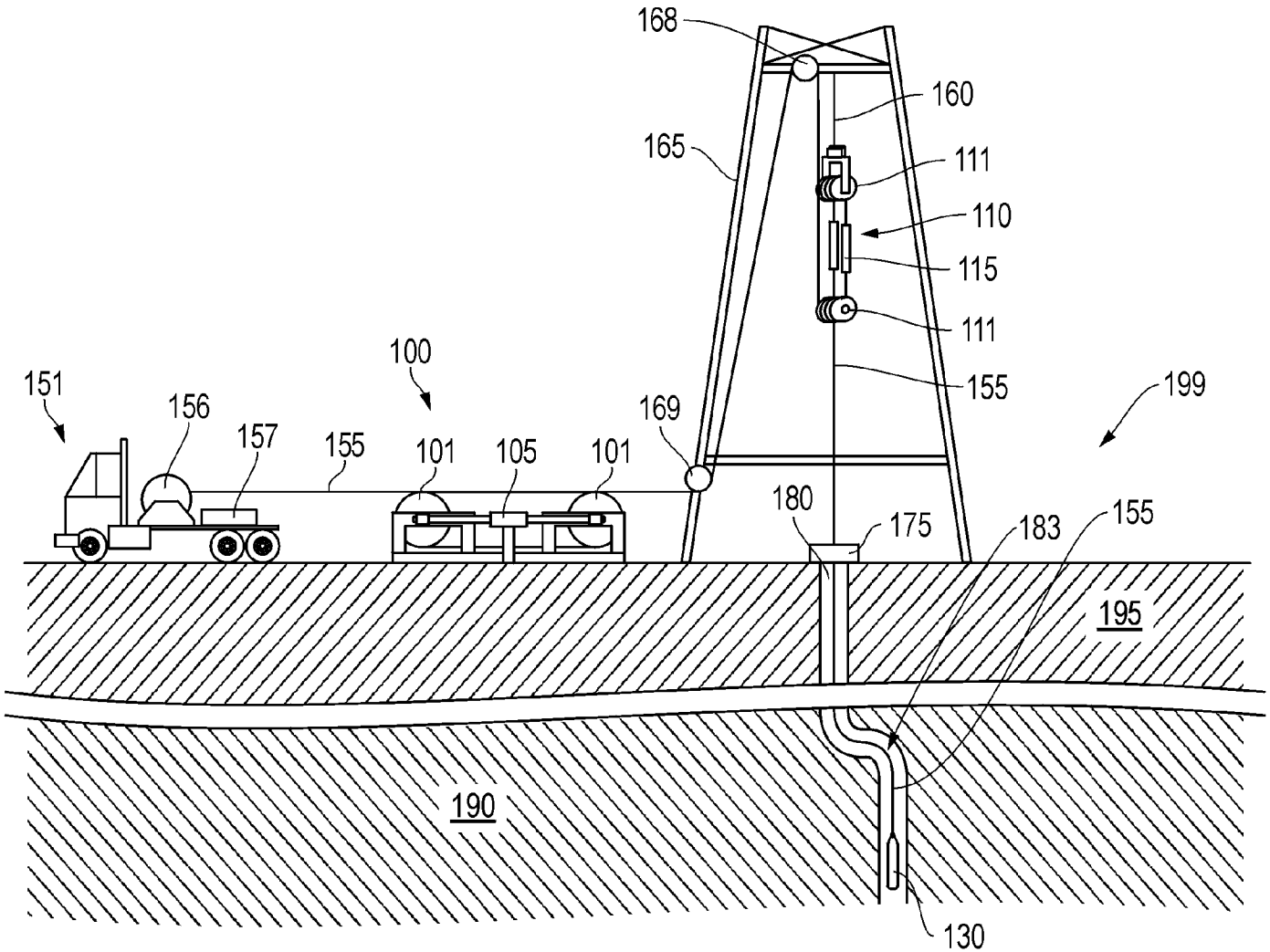
FIG. 1 is a side overview of an oilfield with an embodiment of a well access line positioning assembly employed for positioning a well access line in a well.

Referring now to FIG. 1, an overview of an oilfield 199 is depicted where an embodiment of a well access line positioning assembly (WALPA) 100 is utilized in the positioning of a well access line 155 within a well 180. The WALPA 100 is positioned between the well 180 and a supply of the well access line 155. More specifically, in the embodiment shown, the well access line 155 is a conventional wireline that is supplied from a winch-driven rotatable drum 156 of a wireline truck 151. However, the WALPA 100 may be employed with a variety of well access lines supplied in a host of different manners. For example, the well access line 155 may alternatively be coiled tubing supplied to the WALPA 100 from a conventional coiled tubing reel and injector. Regardless, the WALPA 100 may be employed to regulate tension imparted on the line 155 during positioning in the well 180. Thus, damage such as cold-flow damage and potential breaking of the well access line 155 may be substantially avoided during operations.

Continuing with reference to FIG. 1, a downhole tool 130 is shown coupled to the well access line 155 within the well 180. The well access line 155 may be directed by the rotatable drum 156 to position the downhole tool 130 within the well 180 during an application. For example, the downhole tool 130 may be a logging tool that is dropped into the relatively vertical well 180 as shown. Subsequently, the tool 130 may be withdrawn as data relative to the well 180 and surrounding formations 190, 195 is collected by the tool 130.

During withdrawal of the well access line 155 as described above, significant tension may be suddenly imparted on the line 155. Therefore, in order to prevent damage to the line 155, the WALPA 100 is provided as noted above. For example, due to the potential extensive depth of the well 180, the well access line 155 may generally be removed at rates exceeding about 25,000 feet per hour. Thus, when an obstacle, such as a bend 183 in the well 180, is encountered by the tool 130, there is a significant probability of a sudden spike in tension on the well access line 155. However, as detailed further below, the WALPA 100 may be employed in order to provide an uptake of slack and regulate the amount of this tension on the line 155. Furthermore, in addition to the depicted bend 183, other obstacles may include a well obstruction, restriction, differential sticking of the tool 130 or a malfunctioning tractor coupled to the tool 130 to name a few. Regardless, the WALPA 100 may be employed to regulate tension and minimize or prevent line damage.

More specifically, the WALPA 100 is equipped with two pulleys 101 which are biased relative to one another by the well access line 155 itself. That is, the well access line 155 is wrapped around the biased pulleys 101 multiple times as it makes its way from the drum 156 to the well 180 (see FIG. 2B). In the embodiment shown, the pulleys 101 are positioned horizontally relative to one another. However, in another embodiment, the pulleys 101 may be oriented vertically relative to one another, for example, to reduce the footprint of the WALPA 100 at the oilfield 199.

Continuing with reference to FIG. 1, a tension control mechanism 105 is employed to regulate the above noted biasing of the pulleys 101 relative to each other. This, in turn will regulate the uptake of slack in the line 155 to and from the WALPA 100. So, for example, when a predetermined load or amount of tension is imparted on the line 155, due to the tool 130 encounter with the bend 183, the pulleys 101 may draw toward one another affording a take-up of slack in the line 155 and preventing tension from substantially exceeding the predetermined level. As such, damage to the well access line 155 from the sudden spike in tension may be largely avoided. In fact, as detailed in FIGS. 3A-3C in particular, techniques may be employed wherein once the pulleys 101 reach a predetermined distance (D) from one another, a signal is sent to halt rotation of the winch-driven drum 156 while the pulleys 101 continue to come closer to one another. In this manner, with the pulleys 101 continuing to come together, any delay in halting the rotation of the drum 156 fails to translate into damaging of the line 155.

Continuing with reference to FIG. 1, the wireline truck 151 may be equipped with a control unit 157 for directing an operation with the line 155 such as the logging operation noted above. Furthermore, the control unit 157 may be configured to control the drum 156, whether for advancing the downhole tool 130 in the well 180, withdrawing the tool 130, or even for halting the rotation as described above.

The WALPA 100 itself may be a sizeable unit for employing in a stationary manner at the oilfield 199 as shown. As such, the WALPA 100 may also function as a powered capstan with the pulleys 101 rotating to provide a significant portion, if not a majority, of the power to the line positioning operation. In this manner, cold-flow damage to the line 155 at the drum 156 may be substantially avoided. For example, in one embodiment, where 25,000 lbs. of force is provided to withdraw the line 155 from the well 180, less than about 3,000 lbs. may be directed through the drum 156, whereas the WALPA 100 may provide at least about 22,000 lbs. to the operation.

In another embodiment, no more than 1,500 lbs. on the line 155 is directed through the drum 156. In such an embodiment, scramble winding of the line 155 about the drum 156 may be employed wherein close monitoring of the winding may be avoided. This may allow for the use of a lighter weight, cheaper drum 156 which may help reduce the overall weight of the truck 151.

Continuing with reference to FIG. 1, a derrick 165 is provided at the oilfield 199 so as to provide a means of vertical access to the well 180 by the well access line 155. Additional equipment, such as a vertically aligned WALPA 110 may also be accommodated by the derrick 165. For example, in the embodiment shown, the well access line 155 may be routed through lower 169 and upper 168 sheaves before encountering the vertically aligned WALPA 110. The vertically aligned WALPA 110 may be suspended from the derrick 165 by a suspension cable 160 aligned roughly right over the well head 175 of the well 180. In this manner, vertically direct access to the well 180, with minimal intervening drag may be provided to the line 155.

The well access line 155 may once again be wrapped multiple times about pulleys 111 of the vertically aligned WALPA 110. Just as in the case of the horizontally surface mounted WALPA 100, the pulleys 111 are biased relative to one another and in one embodiment, a tension control mechanism 115 may be provided to serve this end. Furthermore, power for advancing, withdrawing, or otherwise positioning the line 155 within the well 180 may be provided through the pulleys 111 of the vertically aligned WALPA 110. Additionally, in an embodiment employing WALPA's 100, 110 in series as depicted in FIG. 1, the power for positioning the line 155 may be spread out primarily through the pulleys 101, 111 so as to minimize the degree of stress imparted on the line 155 at any given location. Similarly, the majority of the power for positioning of the well access line 155 is provided through pulleys 101, 111 of the WALPA's 100, 110.

In contrast to the surface mounted WALPA 100, the vertically aligned WALPA 110 may be directly aligned with the well 180. As such, any shock or spike in tension on the line 155 may be directly translated to the vertically aligned WALPA 110. That is, the reaction time of the vertically aligned WALPA 110 may be quicker. As such, the vertically aligned WALPA 110 may be configured in line with this potential greater degree of responsiveness. For example, the potential range of distance between the pulleys 111 thereof may be more extensive to take advantage of the greater degree of responsiveness available from the vertical orientation.

Figure 2A:
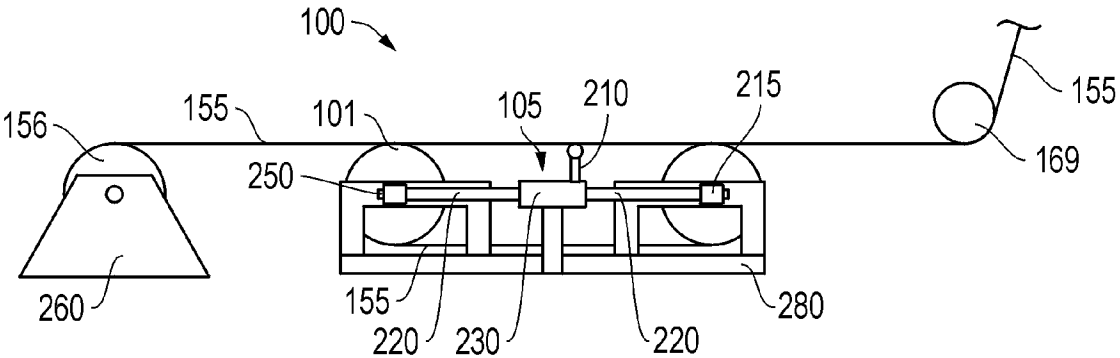
FIG. 2A is an enlarged side view of the well access line positioning assembly of FIG. 1.
Figure 2B:
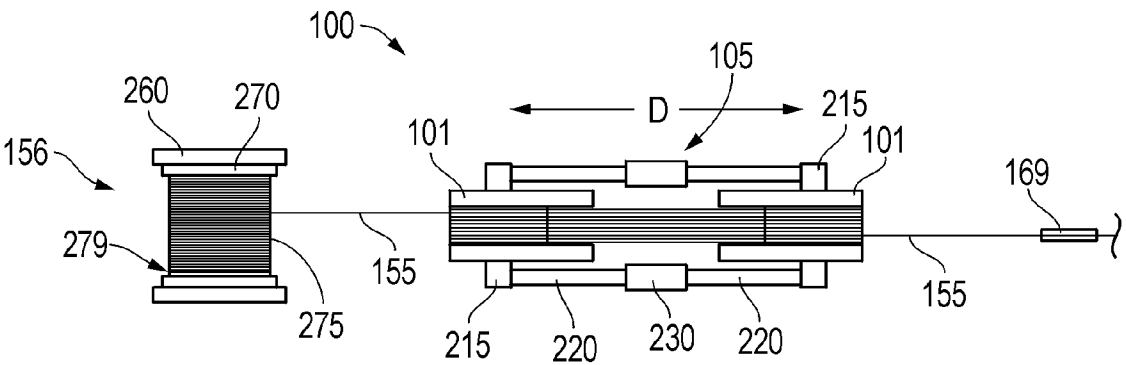
FIG. 2B is an enlarged top view of the well access line positioning assembly of FIG. 1.

Referring now to FIGS. 2A and 2B, side and top views of the surface mounted WALPA 100 are depicted. Other than orientation, the mechanics of the vertically aligned WALPA 110 of FIG. 1 are the same as those described herebelow with respect to the surface mounted WALPA 100.

The surface mounted WALPA 100 of FIG. 2A is positioned between the supply of well access line 155 at the drum 156 and the well 180 of FIG. 1. More particularly, for the surface mount version of the WALPA 100, an equipment base 280 is included. The base 280 is secured at the oilfield 199 adjacent a derrick 165 through which the line 155 is routed to the well 180 (see FIG. 1). With particular reference to FIG. 2A, the routing of the line 155 in this manner can be seen in its turn around the lower sheave 169. FIG. 2A also depicts a drum base 260 for securing the rotatable drum 156 along with the noted equipment base 280 for accommodating the equipment of the WALPA 100. In the embodiment depicted, the drum base 260 and drum 156 may be provided to the oilfield 199 in a relatively mobile manner as depicted in FIG. 1. In contrast, the equipment base 280 and overall WALPA 100 may be a more immobile unit configured for maximizing power output for positioning of the well access line 155 as described above.

With more particular reference to the WALPA 100 itself and added reference to FIG. 2B, the pulleys 101 are shown with the well access line 155 wrapped thereabout as noted above. Each pulley 101 is configured to rotate about a hub 215 that is slidably secured within a track 250. Thus, tension on the line 155 provides force encouraging the pulleys 101 to move toward one another. However, a tension control mechanism 105 is provided which allows the pulleys 101 to move toward one another only once a predetermined amount of tension in the line 155 is reached as detailed further below. In the embodiment shown, the tension control mechanism 105 includes a hydraulic housing 230 which receives arms 220 that are coupled to the noted hubs 215. In this manner, the pulleys 101 may be biased relative to one another in a controlled manner depending on the amount of tension in the line 155 in light of the predetermined amount of tension set for the hydraulic housing 230.

Also depicted in FIG. 2A is a line metering device 210 positioned between the pulleys 101. The device 210 may be employed to contact the well access line 155 and keep track of the amount that is advanced or retracted during the above-described positioning. This data may be used to help aid in the line positioning operation. In the embodiment shown, the device 210 is secured to the hydraulic housing 230 between the pulleys 101. However, it may be positioned elsewhere between the pulleys 101 or alternatively at an interface with a pulley 101. Locating the metering device 210 in such locations avoids the possibility of an unaccounted for variable angling of the line 155 during metering, thus helping to ensure accuracy of the metering. Similarly, the device 210 may include tension-measuring capacity relative to the line 155. Alternatively, a separate tension-measuring device may be located between the pulleys 101.

Continuing with reference to FIG. 2B, a top view of the drum 156, WALPA 100, and lower sheave 169 are depicted with the well access line 155 running therethrough. From this view, the wrapping of the line 155 about the pulleys 101 of the WALPA 100 is apparent. In this depiction, the initial distance (D) between the pulleys 101 is noted as measured between the indicated hubs 215. In one embodiment, these hubs 215 may be set at a distance (D) of at least about 5 feet apart. Thus, with the line 155 wrapping about the pulleys 101 about 5 times, it can be appreciated that the WALPA 100 may accommodate slack in excess of 50 feet or more of line 155. As detailed further below, much, if not most, of this accommodated line 155 may be utilized to provide slack and avoid damage to the line 155 from shock as a result of a sudden spike in line tension.

With continued reference to FIG. 2B, the drum 156 is depicted with flanges 270 at each side thereof. As indicated above, the well access line 155 may be susceptible to cold-flow, where internal layers thereof are damagingly stretched or compressed, particularly at the drum 156. For a conventional wireline operation, this may be of particular concern at the core-flange junction 279, where the noted flanges 270 intersect the underlying core of the drum 156. Similarly, this may be of added concern where upper layers off the line 155 are wound about the core of the drum 156 with substantially greater tension than that of underlying layers. However, in the embodiments described herein, with a WALPA 100 (or 110 of FIG. 1), providing the majority of the power for the line positioning operation, the likelihood of cold-flow damage to the line 155 at the core-flange junction 279 or elsewhere is substantially reduced. Indeed, as indicated above, for embodiments described herein, tension of the well access line 155 may be less than about 1,500 lbs. at the drum 156, and perhaps as low as about 500 lbs., thereby substantially eliminating cold-flow damage to the line 155 at the drum 156.

Figure 3A:
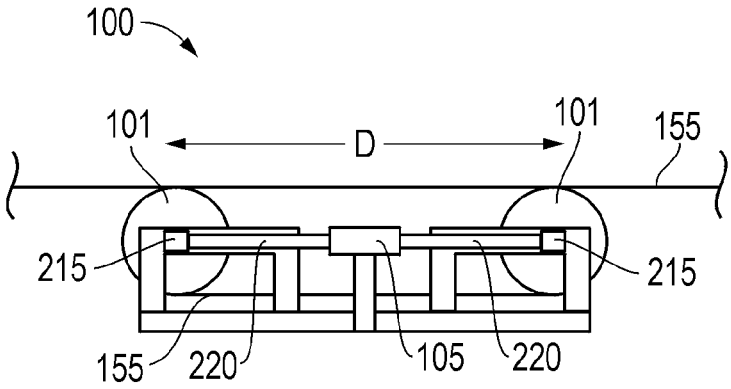
FIG. 3A is a side view of the well access line positioning assembly in a running position.
Figure 3B:
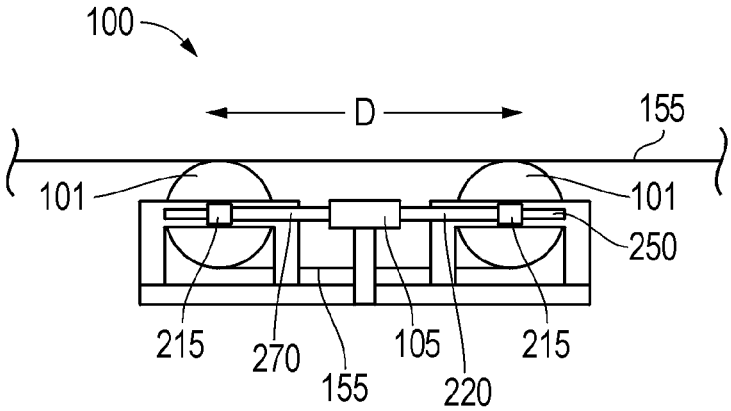
FIG. 3B is a side view of the well access line positioning assembly in a brake-point position.
Figure 3C:
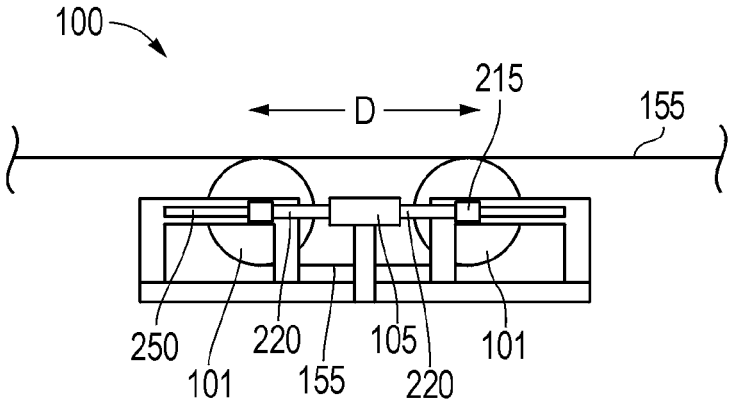
FIG. 3C is a side view of the well access line positioning assembly in a braked position.

Referring now to FIGS. 3A-3C, the above described WALPA 100 is detailed with its pulleys 101 moving from an initial running position in FIG. 3A to a brake-point position in FIG. 3B and finally to a braked position in FIG. 3C. For example, the pulleys 101 may be separated by an initial distance (D) during normal positioning operations relative to the well access line 155. However, as tension in the line 155 fluctuates, the pulleys 101 may move relative to one another. At some point, tension may exceed a predetermined amount forcing the pulleys 101 to within a predetermined distance (D), referred to herein as a brake-point position as depicted in FIG. 3B. Once the brake-point position of FIG. 3B is reached, a signal may be sent by conventional means to halt the rotation of the drum 156 (see FIG. 1). Halting of the operation in this manner may involve an inherent delay, perhaps of a few milliseconds. Nevertheless, the pulleys 101 may be allowed to continue toward one another until separated by final distance (D) as depicted in FIG. 3C with the pulleys 101 in a braked position. Thus, the tension on the well access line 155 never substantially exceeds the predetermined amount, thereby avoiding significant damage to the line 155.

Continuing with reference to FIGS. 3A-3C, the above manner of avoiding damaging shock to the well access line 155 is detailed further with reference to an embodiment of a particular line 155 in a well access operation. For example, the well access line 155 may be rated with a 10,000 lb. load capacity. In this embodiment, the pulleys 101 may be biased relative to one another and configured to move toward one another once 65% of the load capacity of the line 155 is reached. That is, the tension control mechanism 105 may be set to allow movement of the pulleys 101 toward one another once tension exceeds 6,500 lbs. Similarly, the WALPA 100 may be configured to halt the operation altogether once the pulleys 101 come to within a predetermined distance of one another. So, for example, when a downhole obstruction such as a bend 183 is encountered in a logging tool 130 retrieval application as depicted in FIG. 1, the above described mechanics of the WALPA 100 may begin to unfold to as to avoid damage to the well access line 155. Namely, the pulleys 101 will move toward one another until the obstruction is either overcome or the retrieval operation is halted.

With specific reference to FIG. 3A, the pulleys 101 are separated by an initial running distance (D) that in one embodiment is about 5 feet. However, in other embodiments, this distance (D) may be 8 feet or more. Continuing with the embodiment described above, the hydraulic arms 220 are set to maintain the pulleys 101 separated by this distance (D) so long as tension in the line 155 remains below 6,500 lbs.

With reference to FIG. 3B, the tension in the well access line 155 has exceeded the predetermined threshold of 6,500 lbs. Thus, the pulleys 101 are drawn toward one another with the hubs 215 sliding along the tracks 250 and shortening the distance (D). Indeed, as alluded to above, the pulleys 101 may reach a brake-point position with the distance (D) down to about 2 feet, thereby initiating halting of retrieval operations as indicated above. Alternatively, however, where the pulleys 101 fail to come to within the predetermined distance of 2 feet, operations may continue, perhaps even with tension on the line 155 reducing and the pulleys 101 returning to the initial running position depicted in FIG. 3A.

As depicted in FIG. 3C, the WALPA 100 may ultimately be stopped altogether so as to avoid damage to the well access line 155. For example, once passing the 2 foot distance (D) referenced above with regard to FIG. 3B, signaling to halt operations may occur. In the few milliseconds of delay between signaling and achieving the braked position of FIG. 3C, the distance (D) may shrink down to about 1 foot in the embodiment shown. The exact amount of this shrinkage would be dependent on the rate of withdrawal of the line 155, which generally exceeds about 25,000 feet per hour. Regardless, with about a foot of shrinkage as indicated, in an embodiment where the line 155 is wrapped about the pulleys 101 five times, this means that about 10 feet of slack has been taken up and afforded by the WALPA 100 during the delay so as to prevent damage to the line 155.

Figure 4:
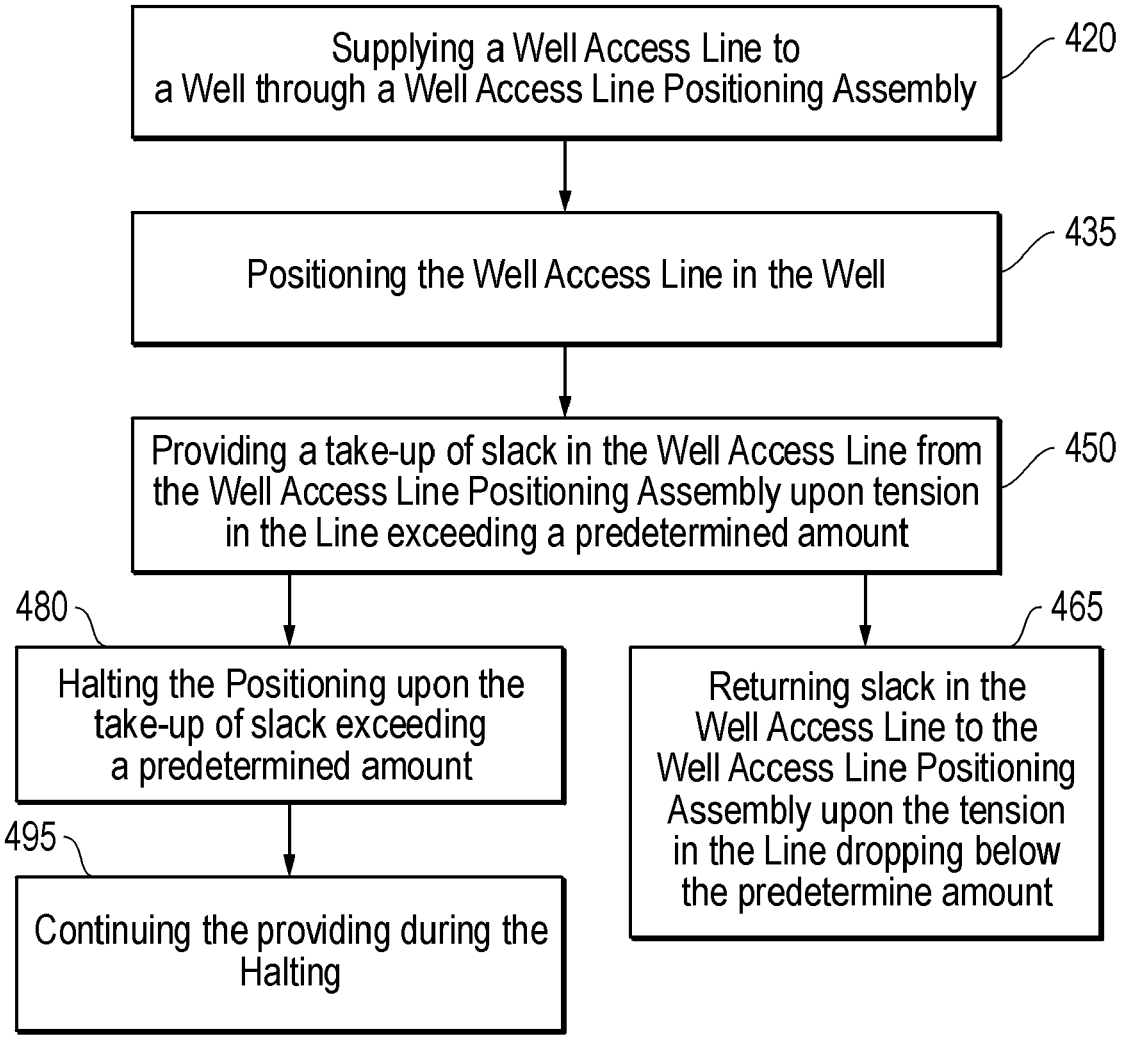
FIG. 4 is a flow-chart summarizing an embodiment of employing a well access line positioning assembly.

Referring now to FIG. 4, a method of employing a well access line positioning assembly as detailed above is summarized in the form of a flow-chart. Namely, a well access line such as a conventional wireline cable is run to a well through a well access line positioning assembly as indicated at 420. The line may then be actively positioned within the well as noted at 435. As detailed above, this positioning may include withdrawing of the line from the well such as in a conventional logging application. However, positioning may also include advancing of the line into the well, which may be of particular concern where the line is coiled tubing, for example. Regardless, as indicated at 450 the well access line positioning assembly is configured to allow for a take-up of slack in the line once tension exceeds a predetermined amount. In this manner damage to the line may be avoided.

In certain circumstances the tension in the line may naturally drop again to below the above noted predetermined amount. As indicated at 465, where this occurs, slack may be returned to the well access line positioning assembly where it may again be made available should another spike in tension arise. However, in other circumstances, tension in the line may exceed the predetermined amount to the point that a predetermined amount of slack is taken up, resulting in a halting of the positioning operation altogether (see 480). The amount of slack take-up required to trigger a halting of the operation may be based on distancing of pulleys of the assembly relative to one another as detailed above. Regardless, as indicated at 495, slack may continue to be taken up during the halting. In this manner, damage to the line may be avoided even in light of a possible delay in achieving a complete halting of the operation.

Figure 5:
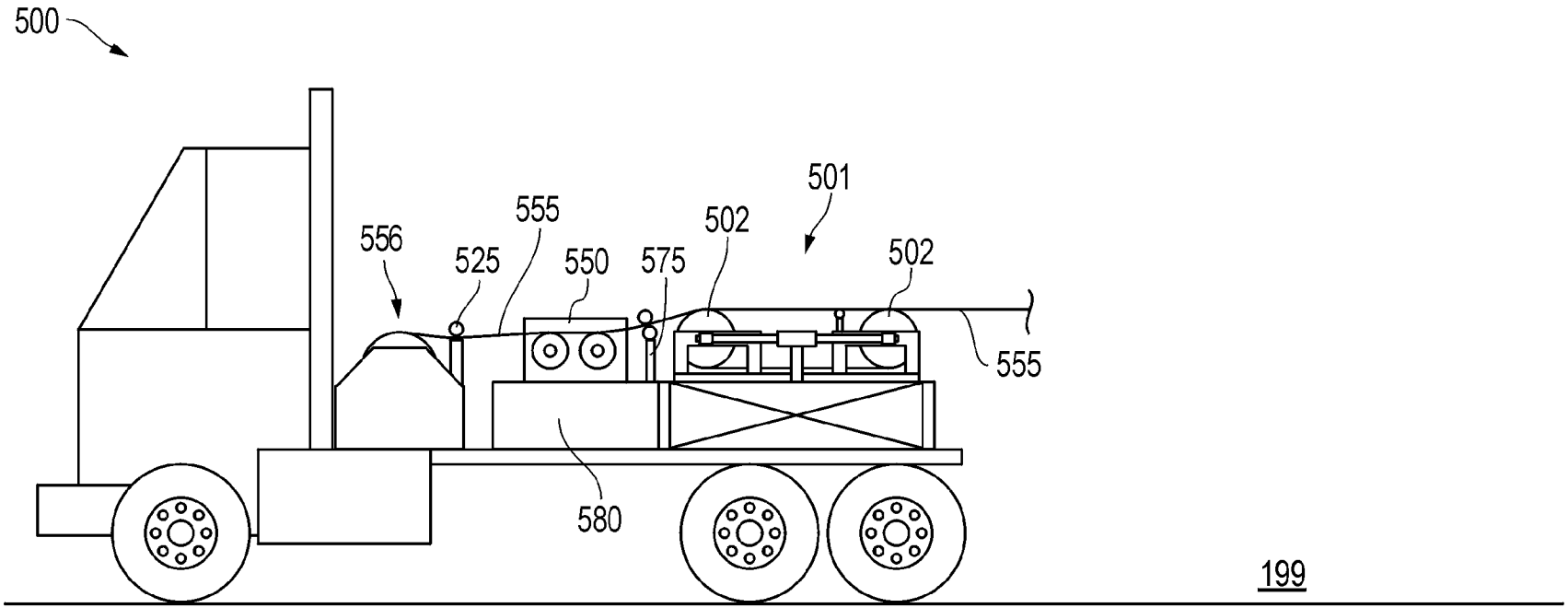
FIG. 5 is a side overview of a mobile embodiment of a well access line positioning assembly.

Referring now to FIG. 5, a side overview of a mobile embodiment of a well access line positioning assembly (WALPA) 501 is depicted. In contrast to the surface mounted or derrick mounted embodiments detailed above, the mobile WALPA 501 is incorporated into the wireline truck 500 right alongside the wireline drum 556. In the embodiment shown, the wireline 555 is routed through a separate capstan 550 and intervening spooler 525 and centering 575 rollers. A control unit 580 may also be provided to direct the operation. Such a mobile embodiment may be particularly well suited for use with a wireline 555 having a load capacity of less than about 5,000 lbs. In this manner, power requirements for positioning of the wireline 555 may be less extensive and more conducive to being met by a mobile wireline truck 500. In one embodiment, the mobile WALPA 501 is employed in conjunction with a deviated well of less than about 5,000 feet.

Embodiments detailed hereinabove include a well access line positioning assembly that allows for an inherent delay in shutting down the feed of a well access line into or out of a well without resulting in significant damage to the line as a result of the delay. So, for example, even where the line is being advanced or withdrawn at rates exceeding 25,000 feet per hour, an increase in tension sufficient to effect operation shut down fails to also result in damage to the line due to the inherent delay in achieving the shut down. Furthermore, the embodiments detailed herein do not require that the positioning or withdrawal speed of the operations be reduced in order to avoid damage to the well access line.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments described herein focus on a well access line that is a wireline cable. However, any number of well access lines, including coiled tubing and others, may be employed with embodiments of logging heads as described hereinabove for a host of different operations. In the case of coiled tubing operations, the well access line positioning assembly may be positioned between a conventional injector and the well. In such an embodiment, the uptake in slack afforded by the assembly may more probably be taken up upon encountering of an obstruction during advancement of the coiled tubing into the well as opposed to during the withdrawal. However, this would not necessarily be the case. Regardless, the foregoing description should not be read as pertaining only to the precise structures described and shown in the accompanying drawings, but rather should be read as consistent with and as support for the following claims, which are to have their fullest and fairest scope.

We claim:

1. A well access line positioning assembly for accessing a well at an oilfield, the assembly comprising:

a first pulley;

a second pulley; and a well access line about said first pulley and said second pulley, said pulleys biased relative to one another by said well access line with an adjustable distance there between based on a predetermined amount of tension in said well access line.

2. The well access line positioning assembly of claim 1 further comprising a tension control mechanism coupled to each of said pulleys for regulating the adjustable distance.

3. The well access line positioning assembly of claim 2 wherein said tension control mechanism comprises:

a first arm coupled to said first pulley;

a second arm coupled to said second pulley; and a hydraulic housing slidably accommodating said arms.

4. The well access line positioning assembly of claim 3 wherein said hydraulic housing is set to allow said arms to slidably retract to reduce the adjustable distance upon the predetermined amount of tension.

5. The well access line positioning assembly of claim 1 wherein said pulleys are configured for one of vertical alignment over the well and horizontal alignment at the oilfield.

6. The well access line positioning assembly of claim 1 wherein said first pulley is vertically oriented relative to said second pulley to minimize a footprint of the assembly at the oilfield.

7. The well access line positioning assembly of claim 1 wherein at least one of said pulleys is configured for powering a positioning of said well access line in the well.

8. The well access line positioning assembly of claim 1 wherein said well access line is wrapped about said first and second pulleys multiple times.

9. The well access line positioning assembly of claim 1 further comprising one of a line metering device and a tension-measuring device interfacing said well access line.

10. The well access line positioning assembly of claim 9 wherein the interfacing is between said pulleys.

11. A well access apparatus for accessing a well at an oilfield, the apparatus comprising:

a supply of well access line for the accessing; and a well access line positioning assembly positioned between said supply and the well, said assembly configured to accommodate an amount of slack in the well access line and to release a portion of the slack upon a predetermined amount of tension in the well access line.

12. The well access apparatus of claim 11 wherein said well access line positioning assembly is powered for positioning of the well access line in the well.

13. The well access apparatus of claim 12 wherein said supply is a powered supply, a minority of power for the positioning provided by the powered supply.

14. The well access apparatus of claim 13 wherein said supply of well access line is a drum of wireline, the positioning including a withdrawal of the well access line from the well.

15. The well access apparatus of claim 14 wherein the withdrawal includes scramble winding.

16. The well access apparatus of claim 14 wherein the withdrawal is achieved with less than about 1,500 lbs. of tension on the well access line at the drum.

17. The well access apparatus of claim 11 wherein said well access line positioning assembly is a first well access line positioning assembly, the apparatus further comprising a second well access line positioning assembly coupled to said first assembly through the well access line, said second assembly configured to accommodate an amount of slack in the well access line and to release a portion of the slack upon a predetermined amount of tension in the line.

18. The well access apparatus of claim 17 wherein one of said assemblies is accommodated by a derrick for vertical alignment over the well.

19. The well access apparatus of claim 11 wherein the well access line is one of wireline and coiled tubing.

20. The well access apparatus of claim 19 wherein the well access line is the coiled tubing, the apparatus further comprising an injector disposed between said supply and said assembly for directing the coiled tubing therebetween.

21. The well access apparatus of claim 11 further comprising a mobile truck to accommodate said supply.

22. A method comprising:

supplying a well access line to a well at an oilfield through a well access line positioning assembly;

positioning the well access line in the well; and providing a take-up of slack in the line from the assembly upon tension in the line exceeding a predetermined amount.

23. The method off claim 22 wherein said positioning comprises one of:

withdrawing well access line that is wireline from the well; and advancing a well access line that is coiled tubing into the well.

24. The method of claim 22 wherein the predetermined amount is selected based on a load capacity of the well access line.

25. The method of claim 22 further comprising returning slack in the well access line to the well access line positioning assembly upon tension dropping below the predetermined amount.

26. The method of claim 22 further comprising halting said positioning upon the take-up of slack exceeding a predetermined amount.

27. The method of claim 26 further comprising continuing said providing during said halting.

* * * * *